United States Patent [19]

Okura et al.

[11] 4,034,793

[45] July 12, 1977

[54] PROCESS FOR CASTING A PLATE GRID FOR A LEAD-ACID STORAGE BATTERY

[75] Inventors: Tomoyuki Okura, Moriguchi; Takashi Tatsumi, Osaka; Hitoshi Watanabe, Moriguchi; Hiroaki Murayama, Moriguchi; Yoichi Kobayashi, Moriguchi, all of Japan

[73] Assignee: Shin-Kobe Electric Machinery Co., Ltd., Tokyo, Japan

[21] Appl. No.: 649,984

[22] Filed: Jan. 19, 1976

[51] Int. Cl.[2] ..... B22C 9/22; B22D 25/04; B22D 27/16

[52] U.S. Cl. ..... 164/63; 164/65; 164/119; 164/255; 164/410; 164/DIG. 1; 249/141; 164/61

[58] Field of Search ..... 164/61, 63, 65, 119, 164/254, 255, 410, DIG. 1; 249/141

[56] References Cited

U.S. PATENT DOCUMENTS

| | | | |
|---|---|---|---|
| 53,993 | 4/1866 | Leffler | 249/141 |
| 1,289,355 | 12/1918 | Andreae | 249/141 X |
| 1,356,714 | 10/1920 | Hochmann | 249/141 X |
| 1,825,958 | 10/1931 | Kodow | 164/DIG. 1 |
| 2,210,544 | 8/1940 | Galloway | 164/119 X |
| 3,542,330 | 11/1970 | Wirtz | 249/141 |
| 3,692,090 | 9/1972 | Brobeck et al. | 164/410 X |

FOREIGN PATENT DOCUMENTS

| | | | |
|---|---|---|---|
| 423,905 | 2/1935 | United Kingdom | 164/65 |

*Primary Examiner*—Ronald J. Shore
*Attorney, Agent, or Firm*—Woodling, Krost, Granger & Rust

[57] ABSTRACT

In a process for casting a plate grid for a lead-acid storage battery comprising the steps of preparing a casting die assembly including two interengagable die halves between which is formed a casting cavity to cast a plate grid therein and pouring a molten metal of lead or lead alloy into said casting cavity to form said plate grid therein, an air in said casting cavity is vented through gaps between said die halves and then through a narrow air passage in at least one venting member received in either of said die halves so that said venting member is flush with the casting surface of the corresponding die half, said venting member at the top surface having cavity forming portions operatively associated with said die halves.

9 Claims, 9 Drawing Figures

PROCESS FOR CASTING A PLATE GRID FOR A LEAD-ACID STORAGE BATTERY

BACKGROUND OF THE INVENTION

In general, a casting die assembly comprising stationary and movable die halves of soft steel has been used to cast a plate grid for a lead-acid storage battery. A molten metal of lead or lead alloy is poured into a casting cavity or cavities formed between the closed die halves through an ingate and then cooled and solidified to produce a plate grid or grids. Since plate grids to be cast and in particular, the latitudinal members thereof are very thin and therefore, the cavities have a cross section sufficiently small to form such thin grids, no air vent is provided in the die assembly so that the molten metal cannot easily reach all the parts of the cavities. This causes the longitudinal and latitudinal members of the produced grids to discontinue.

In order to avoid such discontinuation of the members, there have been provided air escaping grooves in the casting surfaces of the die halves at the corners of the cavities to allow the air between the die halves to escape therein. However, only such grooves are not sufficient to avoid the discontinuation of the longitudinal and latitudinal members of the grids.

Alternatively or furthermore, many small relieves or bores have been provided in the casting surface of either of the die halves at the areas surrounded by cavity forming grooves, to allow the air to escape. Some of the bores which are far from the ingate, communicate through passageways with each other and also with the atmosphere, if any. However, in case the casting surfaces of the die halves are precisely or flatly finished, the air in its stream is insulated from the bores in the die halves so that it cannot reach them. If the casting surfaces of the die halves are roughly finished, then the gaps are formed between them so that the air can reach the bores, but a part of the molten metal is also intruded into the gaps with the result that undesirable fins would be formed on the produced grids. If such fins extend to the air escaping bores in the die halves, then the bores would be filled with the fins so that they lose their function to allow the air to escape. In addition, lead or lead alloy filled and solidified in the bores is left together with parts of the fins because they are difficult to be removed therefrom. This holds the die halves from being closely engaged, which tends to promote formation of the fins on the grids. Ideally, the air escaping bores are so constructed that a molten metal is no intruded into the bores, but that only air is intruded into them. However, since the bodies of the die halves are sufficiently thick to maintain their physical strength, the bores have been obliged to be formed by drilling and therefore, they could not avoid a large diameter, which allows a molten metal to be intruded into them.

Thus, such conventional casting die assembly tends to produce an undesirable plate grid having either fins or a discontinuation of longitudinal or latitudinal members of the grid.

SUMMARY OF THE INVENTION

Accordingly, it is a principal object of the present invention to provide a process for casting a plate grid for a lead-acid storage battery wherein a thin grid can be produced having neither fins nor discontinuation of the longitudinal and latitudinal members of the grid.

It is another object of the present invention to provide a process for casting a plate grid for a lead-acid storage battery wherein a plate grid having a desirable property can be effectively produced.

In accordance with the present invention, there is provided a process for casting a plate grid for a lead-acid storage battery comprising the steps of preparing a casting die assembly including two interengagable die halves between which is formed a casting cavity to cast a plate grid therein and pouring a molten metal of lead or lead alloy into said casting cavity to form said plate grid therein, characterized by further comprising the step of venting an air in said casting cavity through gaps between said die halves and then through a narrow air passage in at least one venting member in either of said die halves so that said venting member is flush with the casting surface of the corresponding die half, said venting member at the top surface having cavity forming portions operatively associated with said die halves.

In accordance with the present invention, there is also provided a casting die assembly for casting a plate grid for a lead-acid storage battery comprising two interengagable die halves having complementary casting cavity forming grooves; and an ingate to introduce a molten metal of lead or lead alloy into a casting cavity formed between said complementary casting cavity forming grooves, characterized by further comprising at least one venting member received in a venting member receiving recess in either of said die halves on the casting surface thereof so that said venting member is flush with said casting surface of said corresponding die half, said venting member at the top surface having casting cavity forming portions operatively associated with said die halves; an air passage formed between the wall of said venting member receiving recess and said venting member so as to communicate with said casting cavity forming groove; and vent means to vent an air in said casting cavity through said air passage out of said die assembly.

BRIEF DESCRIPTION OF THE DRAWINGS

The above and other objects and features of the present invention will be apparent from the description of a preferred embodiment taken with reference to the accompanying drawings in which.

DETAILED DESCRIPTION OF THE PREFERRED EMBODIMENT

Figure 1:
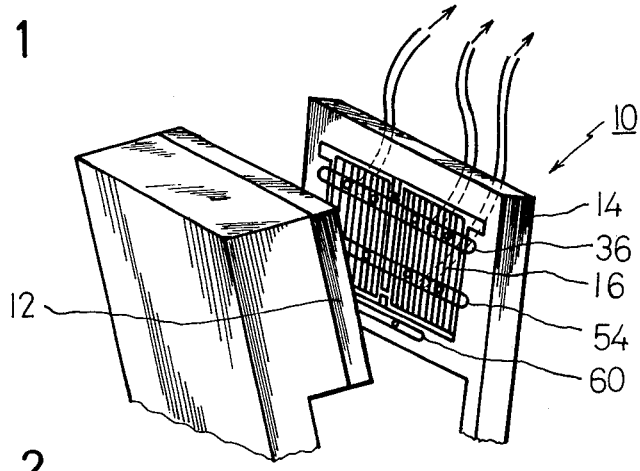
FIG. 1 is a schematically perspective view of a casting die assembly used for a process of the present invention.

FIG. 1 shows a casting die assembly 10 suitable for carrying out a process of the present invention. This casting die assembly 10 comprises a stationary die half 12 of soft steel at the casting surface having casting cavity forming groove (not shown) provided therein, and a movable die half 14 of soft steel at the casting surface having also casting cavity forming groove 16 provided therein. The stationary and movable die halves 12 and 14 may be interengagable by any suitable means to form a casting cavity defined by the casting cavity forming grooves in the die halves 12 and 14. In the illustrated embodiment, the casting cavity may be so arranged that two plate grids may be integrally cast. Of course, it may be so arranged that a single plate grid may be cast.

Figure 2:
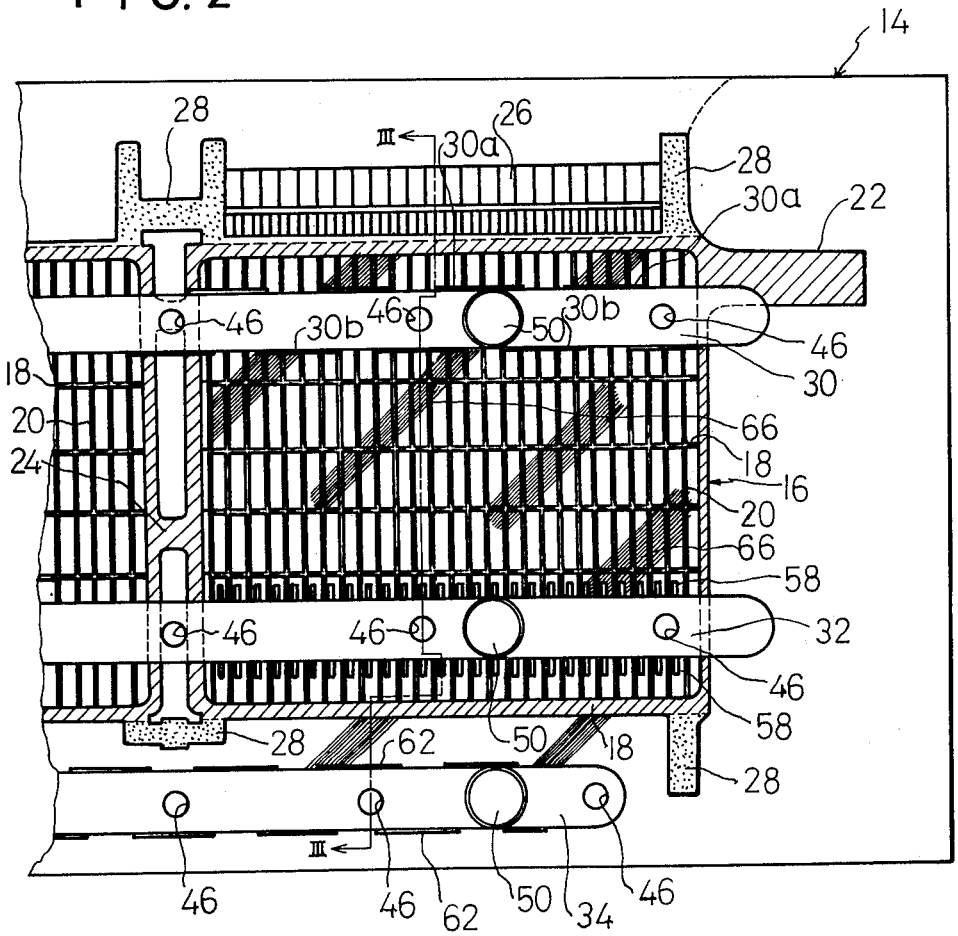
FIG. 2 is an enlarged front view of the movable die half of the die assembly of FIG. 1.

FIG. 2 shown the movable die half 14 in more detail. The cavity forming groove 16 may comprise longitudinal member forming groove portions 18, latitudinal member forming groove portions 20, ear forming groove portions 22, only one of which is shown in FIG. 2, and leg forming groove portion 24. An ingate 26 is provided at the top of the die half 14 to pour a molten metal of lead or lead alloy into the casting cavity in the die assembly 10. The cavity forming groove 16 may also comprise grasping piece forming groove portions 28 which serve to communicate the groove portions 18 to 22 of the cavity to cast two plate grids. The grasping pieces of the plate grids cast by the groove portions 28 are cut away from the plate grid bodies when they are divided individually.

Figure 3:
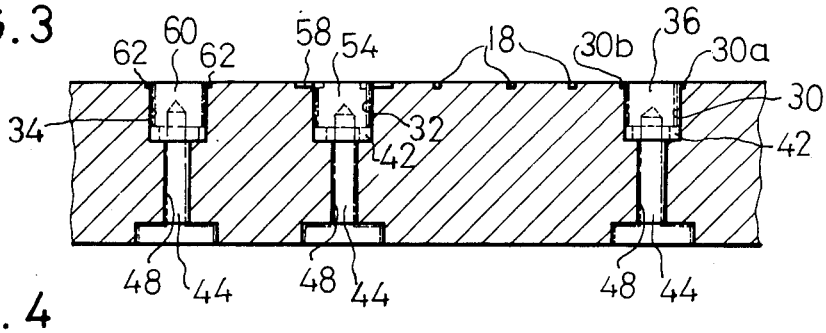
FIG. 3 is a fragmentary cross sectional view of the die assembly taken along the line III—III of FIG. 2.

The movalbe die half also comprises first to third venting member receiving recesses 30, 32 and 34 which are shown in FIG. 3 in a cross section. The first recess 30 may be preferably provided so that it is adjacent to the ingate 26 and extends across the two plate grid forming cavity portions. The second recess 32 may be preferably provided so that it is far from the ingate 26 and extends across the two plate grid forming cavity portions. The third recess 34 may be preferably provided at the area of the casting surface of the die half 14 other than that having the cavity forming groove 16 and far from the ingate 26. This recess may extend along both the casting cavity forming grooves.

Figure 4:
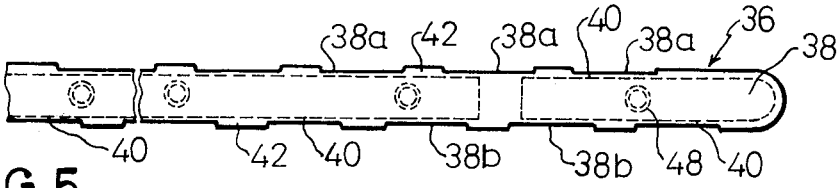
FIG. 4 is a fragmentary front view of a first venting member to be received in the die half of FIG. 2.
Figure 5:
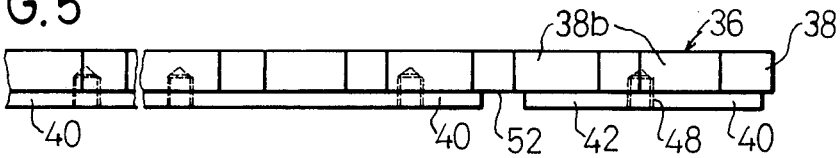
FIG. 5 is a fragmentary side elevational view of the first venting member of FIG. 4.

A first venting member 36 which is to be received in the first recess 30 in the die half 14 is shown in FIGS. 4 and 5 and it may be composed of soft steel. The first venting member 36 may comprise an elongate upper bar 38 and a plurality of lower bars 40 securely mounted on the lower surface of the upper bar 38 in a longitudinally spaced manner as shown in FIGS. 4 and 5. The lower bars 40 may preferably have a width narrower than that of the upper bar 38 so that an air passageway 42 may be formed on the underside of the upper bar 38, as shown in FIG. 3. The first venting member 38 is shown at a phantom line in FIG. 3. The upper bar 38 may be provided on both sides with alternate notches 38*a* and 38*b* which are arranged to face corresponding notches 30*a* and 30*b* on both sides of the first recess 30 when the venting member 36 is received in the first recess 30. Thus, an air can pass through air passages defined by the corresponding notches 30*a*, 30*b*, 38*a* and 38*b* and can reach the passageway 42 formed on the underside of the upper bar 38. The first venting member 36 may be secured to the die half 14 by screws 44 extending through holes 46 in the die half 14 and threadedly engaging threaded holes 48 in the first venting member 36. An air venting hole 50 may extend from the bottom of the first recess 30 through the die half 14 and have a fitting (not shown) to connect the air venting hole 50 with an exhauster not shown (FIG. 1). In FIG. 5, numeral 52 designates a space formed between the adjacent lower bars 40. Thus, the air can enter through the passageway 42 and then through the space 52 into the air venting hole 50, through which the air can be vented by the exhauster.

Figure 6:
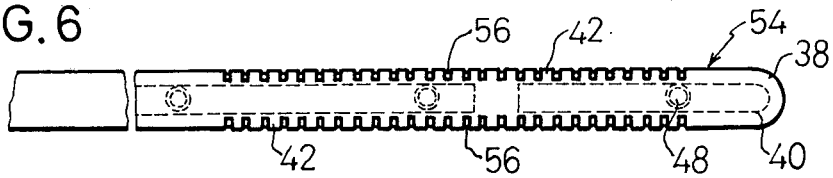
FIG. 6 is a fragmentary front view of a second venting member to be received in the die half of FIG. 2.
Figure 7:
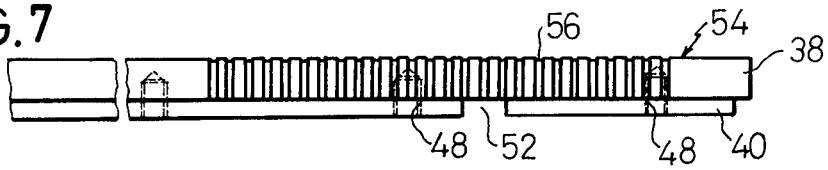
FIG. 7 is a fragmentary side elevational view of the second venting member of FIG. 6.

A second venting member 54 which is to be received in the second recess 32 in the die half 14 is shown in FIGS. 6 and 7 and it may be also composed of soft steel. This venting member 54 may be constructed in a substantially identical manner, except that a plurality of air escaping grooves 56 may be provided in the upper bar 38 succesively at the front and both sides instead of the notches 38*a* and 38*b* of the first venting member 36. The air escaping grooves may be arranged so that they face corresponding air grooves 58 provided at the area of the casting surface surrounded by the longitudinal and latitudinal member forming groove portions 18 and 20, when the second venting member 54 is received in the second recess 32. The same numerals designate the same components.

Figure 8:
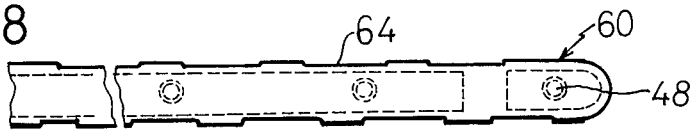
FIG. 8 is a fragmentary front view of a third venting member to be received in the die half of FIG. 2.
Figure 9:
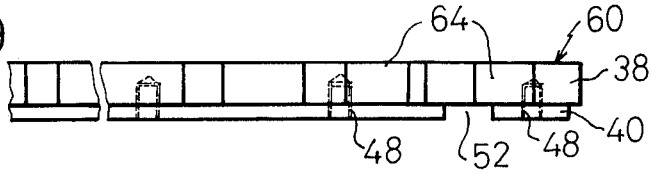
FIG. 9 is a fragmentary side elevational view of the third venting member of FIG. 8.

A third venting member 60 which is to be received in the third recess 34 in the die half 14 is shown in FIGS. 8 and 9 and it may be also composed of soft steel. The venting member 60 may have a construction substantially identical to that of the first venting member 36. Notches 62 correspond to the notches 30*a* of the first recess 30 while notches 64 correspond to the notches 38*a* and 38*b* in the first venting member 36. The same numerals also designate the same components. It should be noted that the notches 30*a* and 62 and the grooves 58 may preferably have a width of 0.05 to 0.2 mm.

On the casting surface of the die half 14 is provided an air path 66 comprising a number of groups of obliquely extending parallel and linear grooves having a width of about 0.2 mm and a depth of about 0.1 mm. These narrow grooves are disposed across both of the longitudinal and latitudinal member forming groove portions and reach the air passage in the venting member. The air path serves to communicate an air between the casting surfaces of the die halves 12 and 14 with the air passage defined by the notches 30*a* and 38*a*, 30*b* and 38*b*, 62 and 64, or the grooves 56 and 58. Thus, when the die halves 12 and 14 are closed, the air between them can pass through the air path 66 so that it is collected in the air passages.

In operation, after the first to third venting members 36, 54 and 60 are received in the first to third recesses 30, 32 and 34 in the movable die half 14, they are secured thereto by the screws 44. It should be noted that at that time the venting members are arranged to be flush with the casting surface of the die half 14. Although not shown in the drawings, the venting members 36 and 54 have cavity forming groove portions provided in the top surfaces in a successive manner so that they are operatively associated with the cavity forming groove 16 of the die half 14 so as to form the plate grids therein. Thereafter, the movable die half 14 is closed so that the die halves 12 and 14 are engaged with each other. As a molten metal of lead or lead alloy is poured from the ingate 26 into the cavity, it flows down through the die assembly 10 at the cavity. At that time, an air remaining in the cavity is compressed and as a result it passes through the air path 66, the air passages defined between the notches or air escaping grooves and then through the passageways of the venting members 36, 54 and 60 and is collected in the spaces 52 of the venting members. The collected air is then forcedly vented by the exhauster which is connected with the air venting holes 50 in the die half 14.

It should be noted that since the notches 30*a*, 30*b*, 38*a*, 38*b*, 62 and 64 and the grooves 58 and 56 have an extremely narrow width of 0.05 to 0.2 mm, the air passages defined by them tends to allow the air to pass therethrough, but not to allow the molten metal to pass therethrough. Of course, the air path 66 in the casting surface of the die half 14 allows only the air to pass therethrough without any passage of the molten metal. Thus, the molten metal cannot be intruded into the gaps (air path) between the closed die halves 12 and 14 and also into the space between the die half 14 and the venting members, with the result that no fins can be produced on the plate grids. It will be understood that this is because the present die assembly is produced by machinework different from that by which the prior art die assembly is produced. Such construction of the air path on the casting surface of the die half 14 and the air passages betweeen the die half 14 and the venting member is one of the features of the present invention.

It should be noted that the air passage defined by the notches 62 and 64 at the area other than that having a cavity forming groove 16 and far from the ingate 26 of the die assembly 10, further promotes an exhaustion of the air between the die halves 12 and 14. This air passage is another feature of the present invention.

As shown in FIG. 2, the air escaping notches 30*a* and 30*b* communicate directly with the latitudinal member forming groove portions 20 while the air escaping groove 58 communicate through a portion of the air path 66 with the longitudinal and latitudinal member forming groove portions 18 and 20. This allows all the air to escape into the air passages between the die half 14 and the venting members 36 and 54. Also, the cavity forming groove at the downstream portions comunicate through the other portions of the air path 66 in the casting surface of the die half 14 with the air passage defined by the notches 62 and 64 so as to release the air out of the cavity forming groove. Thus, a stream of molten metal continues all over the casting cavity. It will be understood that the plate grids can be cast without any discontinuation of the longitudinal and latitudinal members. In FIG. 2, the area of the cavity forming groove portions 18, 22 and 24 at which a hatching is applied shows lead or lead alloy filled therein. Of course, the longitudinal and latitudinal member forming groove portions 18 and 20 are filled with lead or lead alloy in a similar manner.

With the process of the present invention, the molten metal of lead or lead alloy can run all over the casting cavity because the air can be released out of the cavity and therefore, an unguent or stream promoting agent such as powder of cork applied on the casting surface of the die halves 12 and 14 has a longer life time. More particularly, it can be used 6,500 to 7,000 times which is larger than 2,000 to 2,500 times where it can be used in the prior art. This is caused by a lower temperature of the molten metal at which it can flow in the cavity and also by improvement in a stream of the molten metal, both of which prevent removal of the stream promoting agent from the casting surface. Since time in which such agent is sprayed against the casting surfaces of the die halves 12 and 14 is about 20 to 30 minutes, a longer life time of the agent bring about improvement in effectiveness of the production.

It will be understood that the air passageway 42 may be in any suitable form or omitted if the air can be effectively collected in the space 52 under the upper bar 38. It will be also understood that the dimensions, the number and the arrangement of the venting members may be determined on the designs of the die assembly used. If the gaps which are formed between the casting surfaces of the die halves 12 and 14 can introduce the air into the passage or entrance formed between the die half 14 and the venting members, without any intrusion of the molten metal, then the air path 66 may be omitted, based on the conditions such as the velocity of air exhaustion, the thickness and number of the plate grids to be cast. It will be noted that means to release the air out of the die assembly may be alternatively or further provided on the side of the stationary die half.

While one preferred embodiment of the present invention has been described with reference to the accompanying drawings, it will be understood by those skilled in the art that it is by way of example, and that various changes and modifications may be made without departing from the spirit and scope of the present invention, which is intended to be defined only to the appended claims.

We claim:

1. A process for casting a plate grid for a lead-acid storage battery comprising the steps of preparing a casting die assembly including two interengagable die halves between which is formed a casting cavity to cast a plate grid therein, and pouring a molten metal of lead or lead alloy into said casting cavity to form said plate grid therein, characterized by further comprising the step of venting any air in said casting cavity through gaps between said die halves and then through a narrow air passage in at least one venting member received in either of said die halves so that said venting member is flush with the casting surface of the corresponding die half;

said air passing through an air path including a number of groups of obliquely extending parallel and linear narrow grooves in the casting surface of said corresponding die half, said narrow grooves being disposed across both of the longitudinal and latitudinal member forming groove portions of the casting cavity and reaching the air passage in the venting member whereby only the air reaches said air passage without any intrusion of said molten metal therein, said venting member at the top surface having cavity forming portions operatively associated with said die halves;

a space being provided in said venting member to communicate with said air passage to collect the air therein, and the air collected in said space forcedly exhausted through an air exhausting hole provided in said corresponding die half so as to communicate with said space in said venting member.

2. A process as set forth in claim 1, and wherein an air passageway is provided in said venting member along the longitudinal axis of said venting member so as to communicate with said air passage and defined by a wide upper bar, at least one narrow lower bar secured to said upper bar and a wall of said venting member receiving recess.

3. A process as set forth in claim 2, and wherein said space is provided in said venting member to communicate with said air passageway to collect the air therein and defined by the adjacent spaced lower bars.

4. A process as set forth in claim 1, and wherein the air is vented through the air passages between either of said die halves and a plurality of venting members received in said corresponding die half.

5. A process as set forth in claim 4, and wherein one of said venting members is disposed at the area of said casting surface other than that having a casting cavity forming groove and far from an ingate of said casting cavity.

6. A process as set forth in claim 5, and wherein the others of said venting members are disposed across said casting cavity forming groove so that one is adjacent to said ingate of said casting cavity and so that another is far from said ingate.

7. A casting die assembly for casting a plate grid for a lead-acid storage battery comprising two interengagable die halves having complementary casting cavity forming grooves; and an ingate to introduce a molten metal of lead or lead alloy into a casting cavity formed between said complementary casting cavity forming grooves, characterized by further comprising at least one venting member received in a venting member receiving recess in either of said die halves on the casting surface thereof so that said venting member is flush with said casting surface of said corresponding die half, said venting member at the top surface having casting cavity forming portions operatively associated with said die halves;

a number of groups of obliquely extending parallel and linear narrow groove portions in the casting surface of the die half having said venting member receiving recess, said narror grooves forming an air path, an air passage formed between the wall of said venting member receiving recess and said venting member so as to communicate with said casting cavity forming grooves through said air path, said narrow grooves being disposed acorss both of the longitudinal and latitudinal member forming groove portions of the casting cavity and reaching the air passage in the venting member;

vent means to vent any air in said casting cavity through said air passge out of said die assembly, said vent means comprising a space provided in said venting member to communicate with said air passage and collect said air therein;

an air exhausting hole provided in said corresponding die half so as to communicate with said space in said venting member, and said air exhausting hole having a fitting to connect an exhauster to said air exhausting hole.

8. A casting die assembly as set forth in claim 7, and wherein a number of said venting members are provided, one of said venting members being disposed at the area other than that having said casting cavity forming grooves and far from said ingate.

9. A casting die assembly as set forth in claim 8, and wherein the others of said venting members are disposed across said casting cavity forming groove portions, one of which is adjacent to said ingate and the other of which is far from said ingate.

* * * * *